US006769169B2

(12) United States Patent
Nishimizu et al.

(10) Patent No.: US 6,769,169 B2
(45) Date of Patent: Aug. 3, 2004

(54) METHOD OF FABRICATING A CORE FOR A TRANSFORMER

(75) Inventors: Akira Nishimizu, Hitachi (JP); Hideki Masuhara, Hitachinaka (JP); Youichi Amako, Niigata (JP); Masanao Kuwabara, Nakajyo (JP)

(73) Assignee: Hitachi, Ltd., Tokyo (JP)

( * ) Notice: Subject to any disclaimer, the term of this patent is extended or adjusted under 35 U.S.C. 154(b) by 12 days.

(21) Appl. No.: 10/359,583

(22) Filed: Feb. 7, 2003

(65) Prior Publication Data

US 2003/0137386 A1 Jul. 24, 2003

Related U.S. Application Data

(62) Division of application No. 09/908,717, filed on Jul. 20, 2001, now Pat. No. 6,611,191.

(30) Foreign Application Priority Data

Jan. 26, 2001 (JP) ..... 2001-018226

(51) Int. Cl.[7] ..... H01F 7/06

(52) U.S. Cl. ..... 29/602.1; 29/606; 336/234; 336/212; 336/221

(58) Field of Search ..... 336/234, 212, 336/221; 29/902.1, 606

(56) References Cited

U.S. PATENT DOCUMENTS 5,583,474 A * 12/1996 Mizoguchi et al. ..... 336/83
5,608,371 A 3/1997 Valencic et al.
5,811,965 A 9/1998 Gu
6,136,458 A * 10/2000 Inoue ..... 428/693
6,551,416 B1 * 4/2003 Herzer ..... 148/108

FOREIGN PATENT DOCUMENTS

JP 08-222454 8/1996

* cited by examiner

*Primary Examiner*—Ahn Mai
(74) *Attorney, Agent, or Firm*—Antonelli, Terry, Stout & Kraus, LLP

(57) ABSTRACT

To provide a technology capable of restraining direct current magnetic deviation in a transformer without providing a gap in a core, an axis of easy magnetization is provided in a second direction intersecting with a first direction along a magnetic circuit of the core to thereby bring a B-H characteristic of a material characteristic of the core into an unsaturated state.

4 Claims, 8 Drawing Sheets

METHOD OF FABRICATING A CORE FOR A TRANSFORMER

CROSS-REFERENCE TO RELATED APPLICATION

This application is a divisional of Application Ser. No. 09/908,717 filed Jul. 20, 2001, now U.S. Pat. No. 6,611,191, the subject matter of which is incorporated herein by reference.

BACKGROUND OF THE INVENTION

The present invention relates to a transformer, particularly to a technology of improving direct current magnetic deviation of a core.

According to a transformer connected with a thyristor or the like on a primary side or a secondary side thereof, there is frequently a case in which direct current magnetic deviation is caused in a core. The direct current magnetic deviation is a phenomenon in which magnetic flux passing through a core is deviated to a side of positive or negative polarity on a B-H characteristic (characteristic of B-H curve) as a result of generating a direct current component in a coil. FIG. 1 is an explanatory view of the direct current magnetic deviation when a load 4 such as a thyristor is connected to a secondary side of a transformer. As shown by FIG. 1, when voltage V1 in a shape of a sine wave is applied to, for example, a primary side winding 2, voltage in a shape of a sine wave is induced at a secondary side winding 3 and current i2 subjected to half-wave rectification by the load 4 flows and forms a direct current component level shown by a dotted line. The direct current component level of the current generates a magnetic field deviated to a positive or negative side (positive side in the drawing) and excites a core 1 in a state of being deviated to one side on a B-H characteristic (characteristic of B-H curve) (direct current magnetic deviation). When the direct current magnetic deviation is caused, loss such as hysteresis loss in the core is increased. Further, in many cases, the core 1 reaches a magnetically saturated state by the direct current magnetic deviation, harmonic components are generated also in magnetostriction and vibration or noise is also increased. Further, depending on cases, excessively large current flows in the primary sidewinding, which destructs an element or the like connected thereto.

As a measure of restraining the direct current magnetic deviation of the transformer, a technology of bringing the B-H characteristic of the core into an unsaturated characteristic as shown by a curve 6 in FIG. 2, is effective. A curve 5 shown for comparison is substantially a characteristic curve of a general core. By widening a range of magnetic field strength having the B-H characteristic shown by the unsaturated characteristic as in the curve 6, an amount of a change of magnetic flux in the case of causing the unsaturated B-H characteristic can be reduced. Conventionally, in order to realize the unsaturated B-H characteristic, (1) magnetic flux density is reduced by increasing a sectional area of the core or (2) the magnetic flux amount is restrained by increasing reluctance of a magnetic circuit by providing a gap portion in the magnetic circuit of the core. (2) is described in, for example, Japanese Patent Laid-Open No. 222454/1996. According to (1) of the prior art, since an amount of the core member is increased, volume or weight of the transformer is increased and the cost is also increased. Depending on cases, iron loss is also increased. Further, (2) gives rise to a reduction in core strength or an increase in noise by magnetic suction force operated at the gap portion.

Particularly, in the case of a three-phase transformer, there is brought about a drawback in which excitation characteristics of respective phrases differ by a dispersion in the gap. Further, depending on cases, the magnetic suction force of the gap portion causes destruction of the core or scattering of debris of the core member.

In view of the above-described prior art, it is the problem of the present invention that in a transformer, (1) direct current magnetic deviation can be restrained without providing a gap in a core, (2) an increase in size or weight is not brought about, (3) an increase in the cost is not brought about.

SUMMARY OF THE INVENTION

It is an object of the present invention to provide a technology capable of resolving such problem.

In order to resolve the above-described problem, according to the present invention:

(1) There is constructed in such a manner that a transformer comprises a core for the transformer in which a B-H characteristic of a material characteristic in a direction along a magnetic circuit is brought into an unsaturated state and a primary side winding and a secondary side winding wound around the core for the transformer and the transformer is operated in the unsaturated region.

(2) There is constructed in such a manner that a transformer comprises a core for the transformer having an axis of easy magnetization in a second direction intersecting with a first direction along a magnetic circuit and a primary side winding and a secondary side winding wound around the core for the transformer.

(3) In the above-described (2), the core for the transformer is constituted by an amorphous metal.

(4) In the above-described (1) or (2), the core for the transformer is constituted by being laminated with core members each in a shape of a thin strip.

(5) In any of the above-described (2) through (4), the axis of easy magnetization of the core for the transformer is formed by applying a magnetic field in an annealing operation.

(6) There is provided a core for a transformer used in any of the transformers according to the above-described (1) through (5).

(7) As a method of fabricating a core for a transformer, the core for the transformer is fabricated after having been processed by a step of laminating core members each in a shape of a strip and forming the core members in a ring-like shape and a step of applying a direct current magnetic field in a direction intersecting with a direction along a magnetic circuit of the transformer to the formed core members in an annealing operation to thereby form an axis of easy magnetization of the core in a direction of the magnetic field.

(8) In the above-described (7), the direct current magnetic field is applied in a direction substantially orthogonal to the direction along the magnetic circuit of the transformer.

(9) As a method of fabricating a core for a transformer, the core of the transformer is fabricated after having been processed by a step of laminating core members each in a shape of a thin strip and forming the core members in a ring-like shape and a step of applying a direct current magnetic field in a first direction along a magnetic circuit of the transformer and a direct current magnetic field in a second direction intersecting with the first direction to the formed core members in an annealing operation to thereby form an axis of easy magnetization of the core in a direction of a magnetic field synthesized with the two magnetic fields.

(10) As a method of fabricating a core for a transformer, a core of a transformer is formed after having been processed by a step of subjecting core members to material taking from a magnetic material having an axis of easy magnetization substantially in a constant direction such that the axis of easy magnetization constitutes a direction intersecting with a direction along a magnetic circuit of the transformer and a step of laminating the core members.

DETAILED DESCRIPTION OF THE PREFERRED EMBODIMENTS

An explanation will be given of embodiments of the present invention in reference to the drawings as follows.

Figure 3:
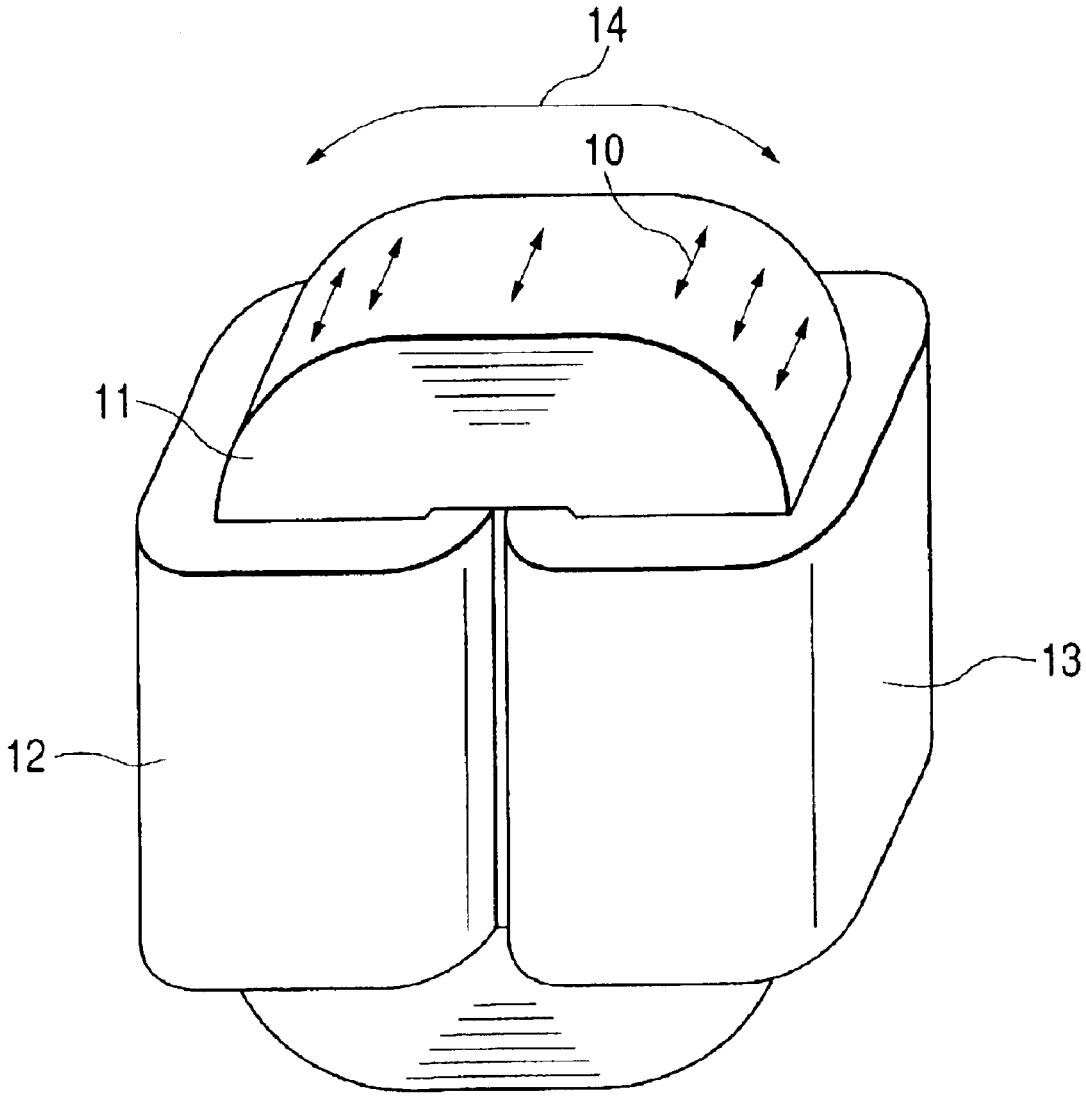
FIG. 3 is a drawing showing a total constitution example of a transformer according to a first embodiment of the present invention.
Figure 4:
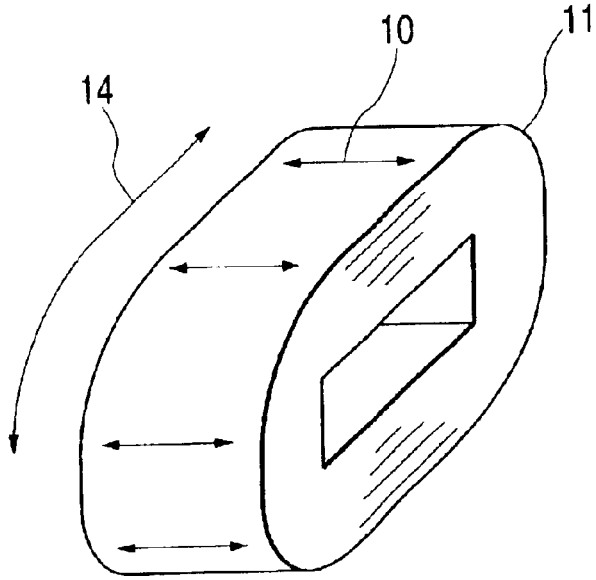
FIG. 4 is a drawing showing a core of the transformer of FIG. 3.

FIGS. 3 and 4 show a first embodiment of a transformer according to the present invention in which FIG. 3 shows a total constitution of the transformer and FIG. 4 shows a constitution of a core for the transformer.

The first embodiment is an example of a case in which a B-H characteristic of a core is constituted by a characteristic in an unsaturated state over a magnetic field strength range wider than normal by directing a direction of an axis of easy magnetization of the core for a transformer in a direction substantially orthogonal to a longitudinal direction of the core (equal to a direction along a magnetic circuit of the transformer) to thereby increase reluctance of the magnetic circuit of the transformer.

Figure 1:
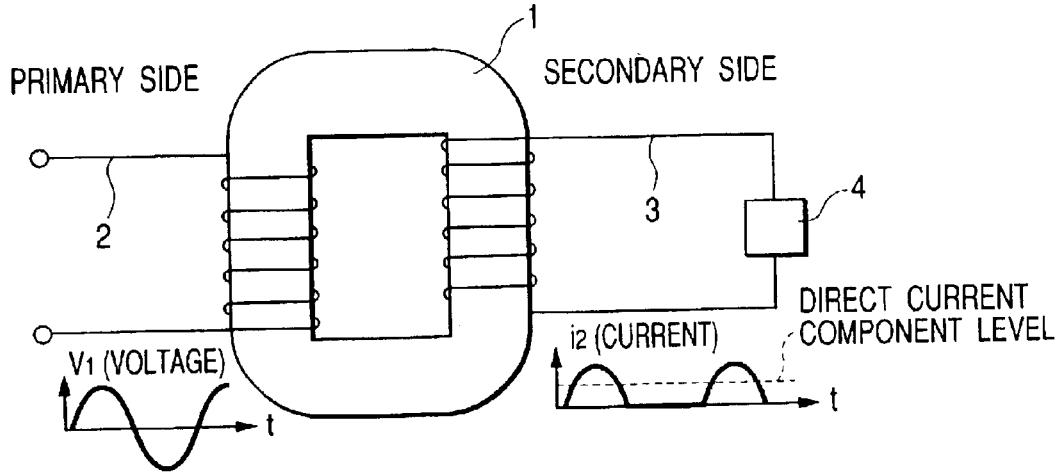
FIG. 1 is an explanatory view of a prior art.
Figure 2:
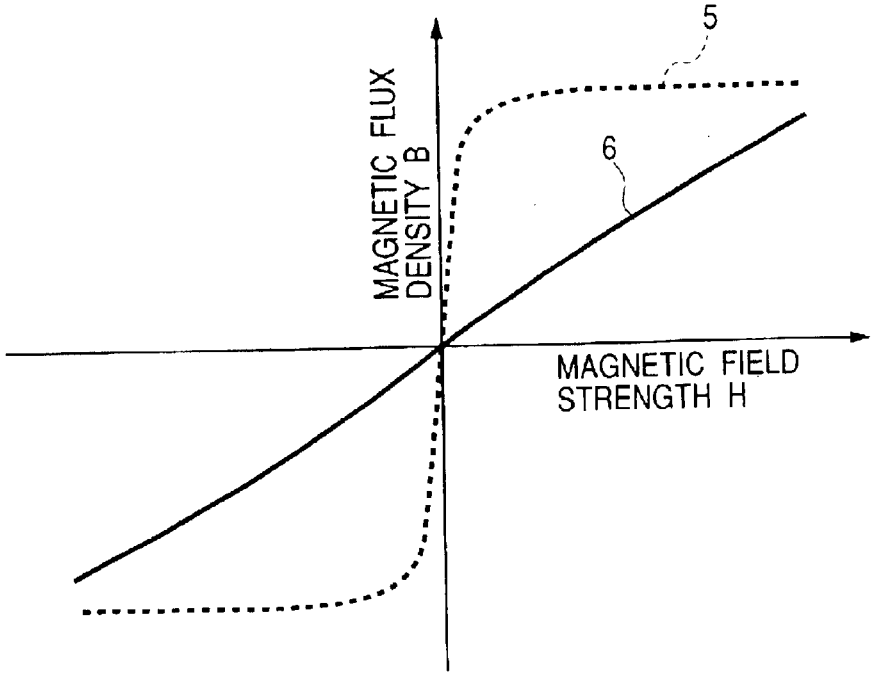
FIG. 2 is an explanatory view of a B-H characteristic of a core of a transformer.

In FIG. 3, numeral 11 designates a core, numeral 12 designates a primary side winding, numeral 13 designates a secondary side winding, numeral 10 designates an arrow mark showing the direction of the axis of easy magnetization and numeral 14 designates an arrow mark showing the longitudinal direction of the core 11 (equal to the direction along the magnetic circuit). According to the constitution, when the core 11 is excited in the longitudinal direction (equal to the direction along the magnetic circuit) of the core 11, since the direction of the axis of easy magnetization of the core is constituted by the direction substantially orthogonal to the direction of the excitation magnetic field, the direction of the excitation magnetic field and the direction of the axis of easy magnetization of the core do not coincide with each other and accordingly, the reluctance of the magnetic circuit is more increased than that in the case in which the two directions (the direction of the excitation magnetic field and the direction of the axis of easy magnetization) coincide with each other and a slope of the B-H characteristic becomes gradual. Therefore, the density of magnetic flux generated by the magnetic field is reduced and the B-H characteristic (B-H curve) of the core 11, is constituted by an unsaturated characteristic over a magnetic field strength range wider than a normal characteristic as shown by the curve 5 in FIG. 2. Therefore, the core 11 is excited by difference current flowing in the primary side winding 12 and the secondary side winding 13 and generates magnetic flux in accordance with the B-H characteristic in the unsaturated state. Therefore, even when a direct current component is included in the difference current and direct current magnetic deviation is caused, a change in an amount of the magnetic flux in the core 11 is inconsiderable and a saturated region is not reached in many cases. Therefore, according to the transformer using the core, loss such as hysteresis loss is inconsiderable and an increase in vibration or noise caused by harmonic components of magnetostriction can be restrained.

FIG. 4 is an outline view of the core 11 used for the transformer of FIG. 3. The core 11 is constructed by a laminated constitution constituted by laminating or winding a magnetic member in a shape of a thin strip. An amorphous metal can also be used for the core member. Further, although according to the embodiment, the direction of the axis of easy magnetization 10 of the core 11 is constituted by the direction substantially orthogonal to the longitudinal direction (equal to the direction along the magnetic circuit) of the core over an entire circumference of the magnetic circuit, the present invention is not limited thereto but the direction of the axis of easy magnetization 10 may be a direction of making an angle other than the right angle relative to the longitudinal direction (equal to the direction along the magnetic circuit) of the core, or the direction of the axis of easy magnetization 10 maybe inclined to the longitudinal direction (equal to the direction along the magnetic circuit) not over the entire circumference of the magnetic circuit but a portion thereof.

Figure 5:
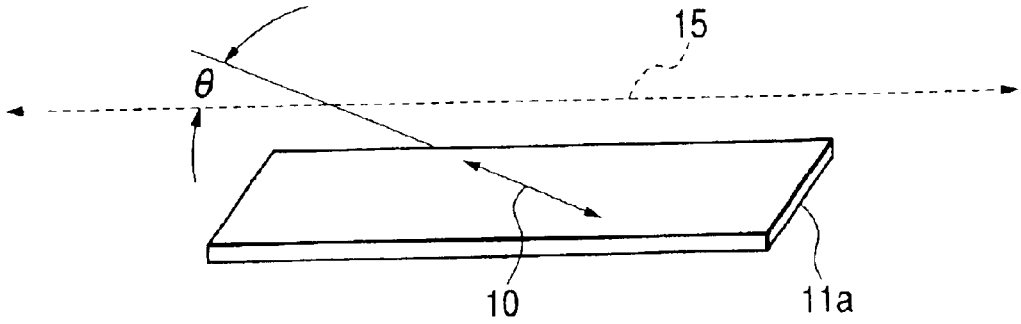
FIG. 5 is a drawing showing a second embodiment of the present invention.

FIG. 5 shows a second embodiment of the present invention which is an example of other structure of a core member for a transformer and is an example of a case in which a direction of the axis of easy magnetization 10 is constituted by a direction making an angle θ other than substantially right angle relative to a longitudinal direction (equal to direction along magnetic circuit) of the core, different from that of the case of the first embodiment. In FIG. 5, numeral 10 designates the axis of easy magnetization, notation 11*a* designates a core material and numeral 15 designates a direction of an excitation magnetic field. The larger the angle θ, the more gradual (the smaller) the inclination of a magnetization curve in a B-H characteristic of the core member 11*a* and when the angle θ is substantially right angle (correspondent to the case of the first embodiment), the inclination becomes minimum. The core for the transformer is constituted by forming the core member 11*a* in a ring-like shape. Also in the case of the constitution in which the axis of easy magnetization 10 is inclined by the angle θ relative to the longitudinal direction (equal to direction along magnetic circuit) of the core, such an axis of easy magnetization may be provided over an entire circumference on the magnetic circuit or such an inclined axis of easy magnetization may be provided at a portion on the magnetic circuit. In the case of the constitution in which the axis of easy magnetization is inclined over the entire circumference, the reluctance is larger than that in the case of the constitution in which the axis of easy magnetization is inclined at a partial position and therefore, the inclination of the magnetization curve in the B-H characteristic becomes more gradual (smaller).

It seems that a magnitude of the slope of the B-H characteristic is derived from the crystal structure of the core member and when the core member is fixed, the magnitude differs by the angle θ made by the axis of easy magnetization relative to the longitudinal direction of the core or a rate of a region of the axis of easy magnetization occupied on the magnetic circuit. Therefore, the B-H characteristic of the core of the transformer can be controlled by changing these factors. Although according to the above-described embodiments of FIG. 3 through FIG. 5, the direction of the axis of easy magnetization is constituted by a substantially constant direction (substantially right angle direction or direction of angle θ relative to direction along magnetizing circuit) at a portion or the entire circumference portion on the magnetic circuit, the present invention is not limited thereto but otherwise, for example, the direction of the axis of easy magnetization may be changed by a position on the magnetic circuit such that the direction of the axis of easy magnetization is in a direction of θ A at portion A on the magnetic circuit, a direction of θ B at position B and a direction of θ C at the position C.

According to the constitutions of the first and second embodiments, even when the direct current magnetic deviation is caused, the change in the magnetic flux amount in the core 11 can be reduced and accordingly, the direct current magnetic deviation can be restrained without providing a gap at the core. Further, vibration or noise can be reduced by reducing harmonic components of magnetostriction. Further, in many cases, the saturated region is not reached and loss such as hysteresis loss can also be reduced.

Figure 6:
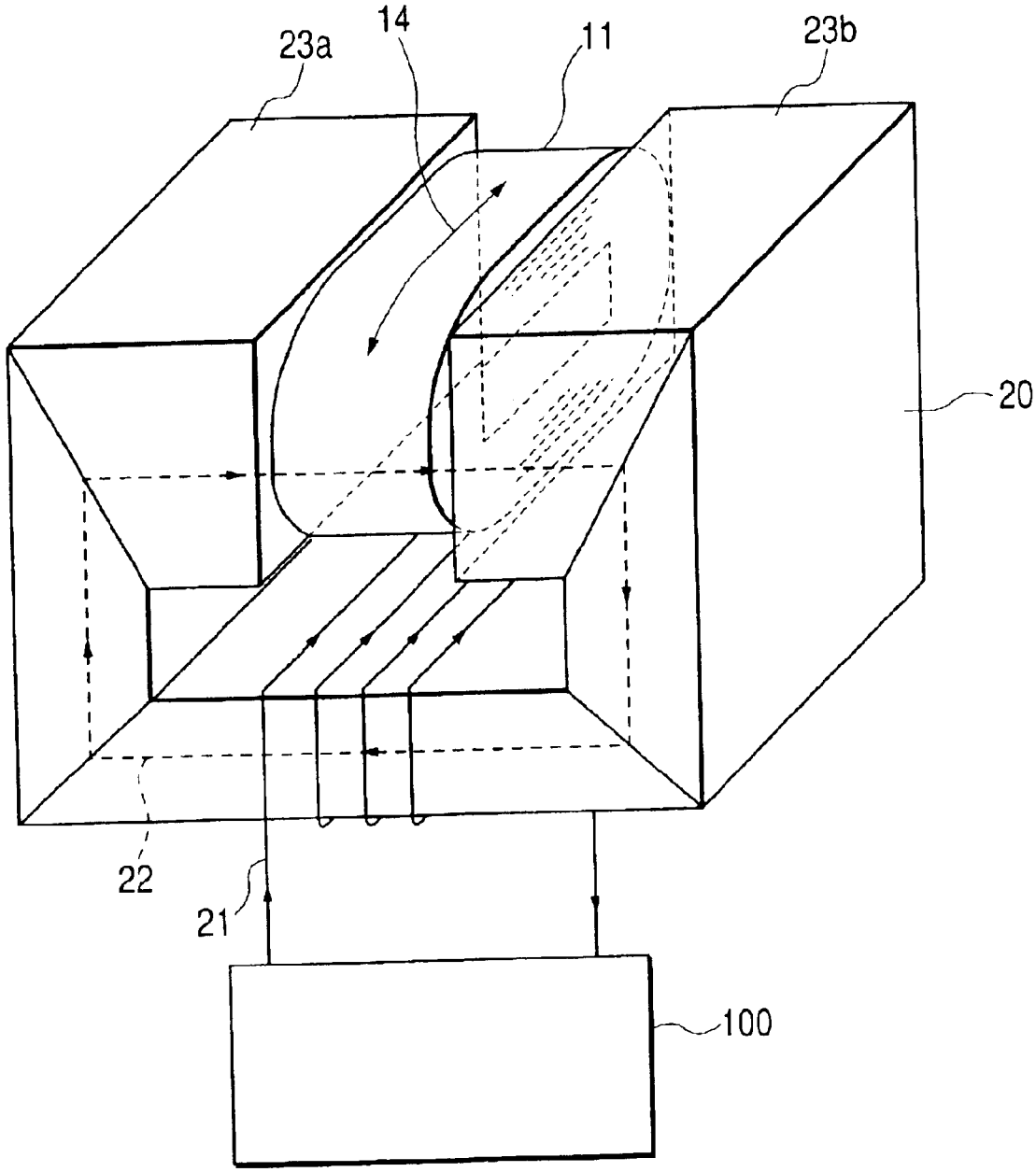
FIG. 6 is an explanatory view of forming an axis of easy magnetization of a core according to a third embodiment of the present invention.

FIG. 6 shows a third embodiment of the present invention and is an explanatory view of a technology for forming an axis of easy magnetization of a core in steps of fabricating a transformer according to the present invention.

In a magnetic member, there is frequently a case in which residual stress caused in working the member is removed by annealing to thereby provide magnetic characteristics inherent to material thereof. Also in the case of the present invention, the annealing is carried out. Particularly, in the present invention, the annealing operation is carried out in a state in which the core is under application of a magnetic field in a direction intersecting with the longitudinal direction (equal to direction along magnetic circuit) of the core to thereby form the axis of easy magnetization of the core in a direction of the applied magnetic field.

The third embodiment is an example in the case in which there is formed an axis of easy magnetization in a direction substantially orthogonal to the longitudinal direction (equal to direction along magnetic circuit) of a core over an entire circumference of the core for a transformer.

In FIG. 6, numeral 11 designates the core for a transformer, numeral 20 designates an excitation electromagnet, numeral 21 designates an excitation coil of the electromagnet 20, notations 23*a* and 23*b* respectively designate magnetic pole portions of a core of the excitation magnet 20, numeral 22 designates a direct current magnetic field generated by the excitation electromagnet 20 and numeral 100 designate a power source for supplying direct current to the excitation coil 21. There is used a magnetic material Curie point of which is higher than highest temperature in the annealing operation for a core member of the excitation electromagnet 20. For example, when a ferrous amorphous member is used for the core 11 for the transformer, an electromagnetic steel sheet is used for the core member of the excitation electromagnetic 20. The core 11 for the transformer is arranged between the magnetic pole portions 23*a* and 23*b* of the core of the excitation electromagnet 20. When direct current is supplied from the power source 100 to the excitation coil 21 of the electromagnet 20, the electromagnet 20 generates the direct current magnetic field 22 for excitation between the magnetic pole portions 23*a* and 23*b* of the core and excites the core 11 for the transformer in a direction (direction of the direct current magnetic field 22) substantially orthogonal to the longitudinal direction (direction along magnetic circuit) 14 of the core. The annealing operation is carried out under the excited state. Thereby, the core 11 for the transformer is formed with the axis of easy magnetization in the direction substantially orthogonal to the longitudinal direction (direction along magnet circuit) 14 of the core 11.

According to the third embodiment, even when the direct current magnetic deviation is caused, the core and the transformer capable of restraining the direct current magnetic deviation by reducing the magnetic flux amount in the core, can be formed by the constitution of the core which is not provided with a gap. Also the exciting operation in annealing is simple, and the operation can be constituted such that an increase in the cost of the core or the transformer is not brought about.

Figure 7:
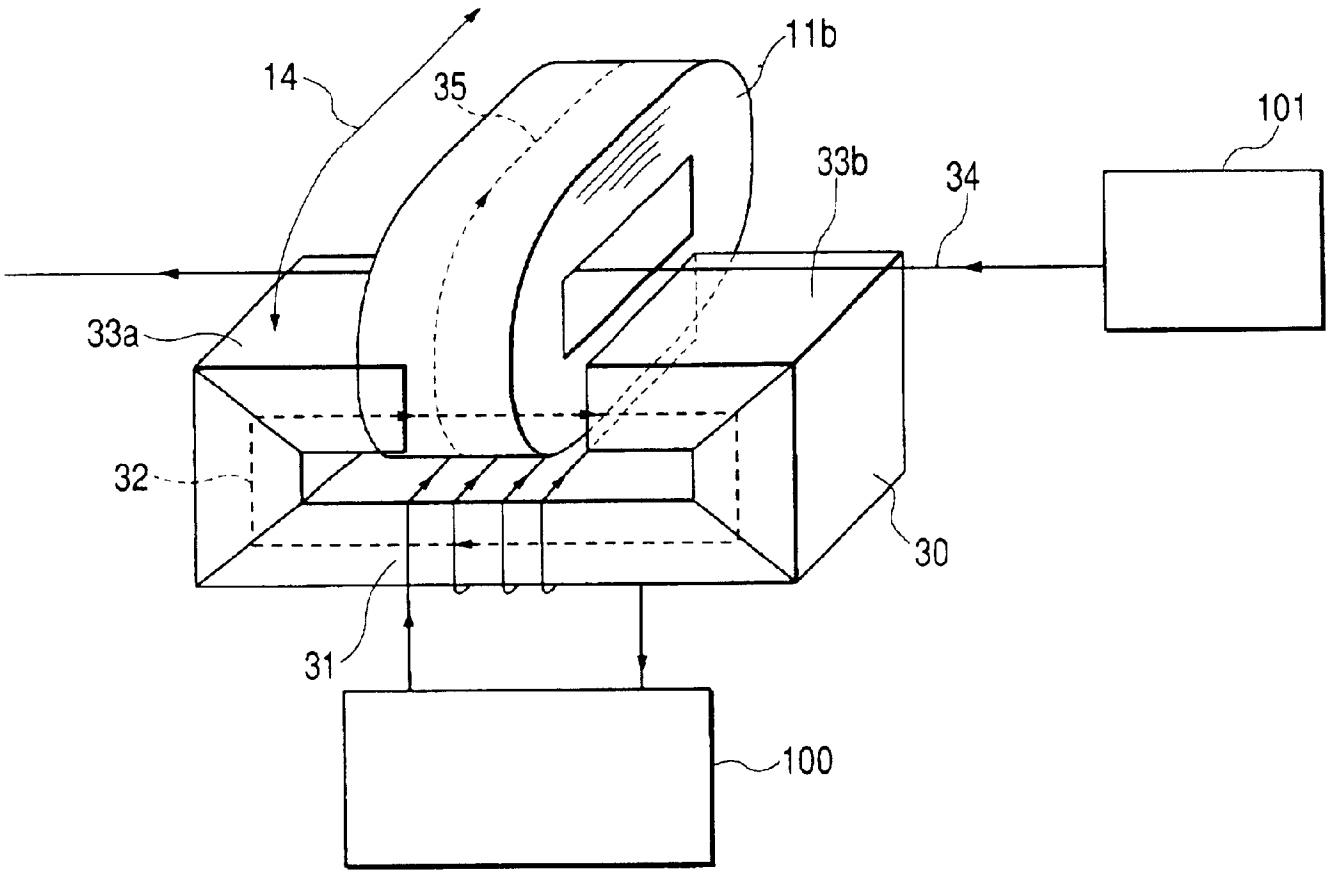
FIG. 7 is an explanatory view of other technology of forming an axis of easy magnetization of a core according to a fourth embodiment of the present invention.
Figure 8A:
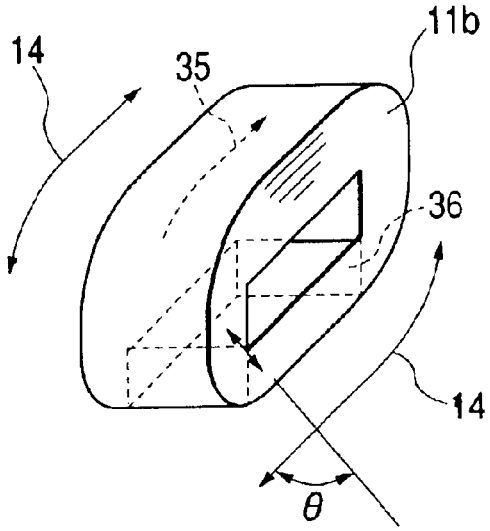
FIGS. 8A and 8B are explanatory views of a magnetic field for forming an axis of easy magnetization according to the technology of FIG. 7.
Figure 8B:
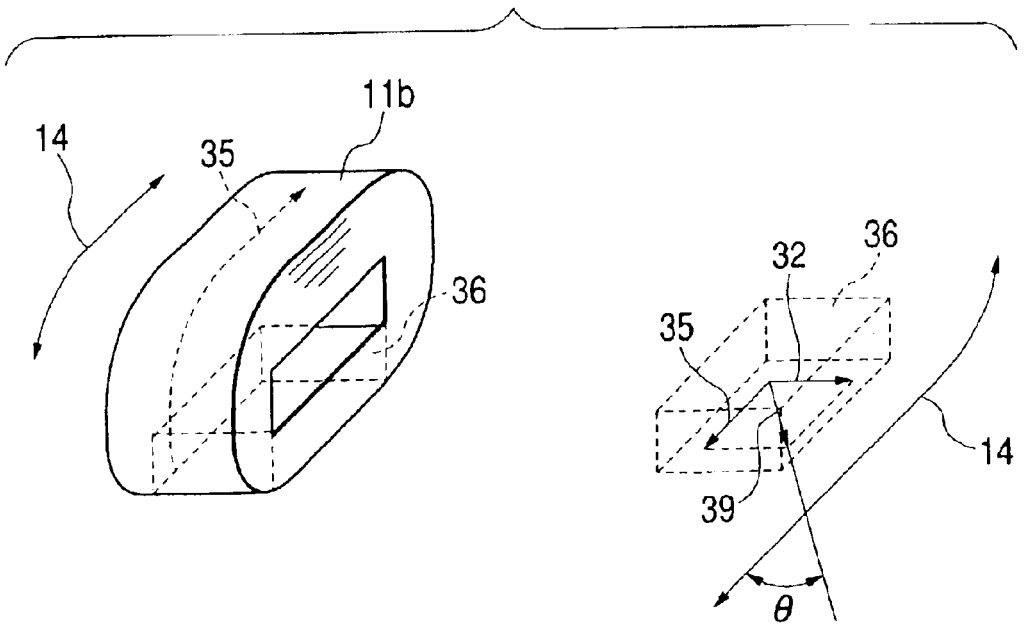

FIG. 7 and FIGS. 8A and 8B show a fourth embodiment of the present invention and are explanatory views of other technology of forming an axis of easy magnetization of a core in steps of fabricating a transformer according to the present invention.

The fourth embodiment is an example in the case in which an axis of easy magnetization is formed in a direction of making an angle θ relative to a longitudinal direction (equal to direction along magnetic circuit) of the core.

FIG. 7 is a constitution view in the case of combining the core for the transformer and an excitation electromagnet and FIGS. 8A and 8B are views of the core for the transformer.

In FIG. 7 and FIGS. 8A and 8B, notation 11*b* designates a core for a transformer, numeral 30 designates an excitation electromagnet, numeral 31 designates an excitation coil of the electromagnet 30, notation 33*a* and 33*b* respectively designate magnetic pole portions of a core of the excitation electromagnet 30, numeral 32 designates a direct current magnetic field generated by the excitation electromagnet 30, numeral 34 designates an excitation conductor penetrating the core 11*b* for the transformer in an axial direction, numeral 35 designates a direct current magnetic field which direct current flowing in the excitation conductor 34 generates at the core 11*b* for the transformer, numeral 36 designates a portion in a longitudinal direction (equal to direction along magnetic circuit) of the core for the transformer and a portion arranged between the magnetic pole portions 33*a* and 33*b* of the core of the excitation electromagnetic 30, numeral 100 designates the power source for supplying direct current to the excitation coil 31 and numeral 101 designates a power source for supplying direct current to the excitation conductor 34. When the direct current is supplied from the power source 100 to the excitation coil 31 of the electromagnet 30, the electromagnet 30 generates the direct current magnetic field 32 for excitation between the magnetic pole portions 33*a* and 33*b*, further, when the direct current is supplied from the power source 101 to the excitation conductor 34, the excitation conductor 34 generates the direct current magnetic field 35 at the core 11*b* for the transformer. At a region of the core 11*b* for the transformer between the magnetic pole portions 33*a* and 33*b* the core of the excitation electromagnet 30, the direct current magnetic field 32 and the direct current magnetic field 35 operate each other and a synthesized magnetic field 39 (FIG. 8B) is generated. The synthesized magnetic field 39 excites the core 11*b* for the transformer at the region 36 in a direction of the synthesized magnetic field, that is, in a direction of making an angle θ relative to the longitudinal direction (equal to direction along magnetic circuit) 14 of the core. When annealing is carried out under the excited state, at the portion (region 36) of the core 11*b* for the transformer on the magnetic circuit, an axis of easy magnetization is formed in the direction of making the angle θ relative to the longitudinal direction (equal to direction along magnetic circuit) 14 of the core 11*b* and at other portion on the circuit, the axis of easy magnetization is formed in the direction of the direct current magnetic field 35. The angle of inclination θ of the axis of easy magnetization at the region 36, can be changed by changing the inclination of the synthesized magnetic field 39 by the direct current magnetic field 32 and the direct current magnetic field 35.

Although according to the fourth embodiment, the inclined axis of easy magnetization is formed only at one location of the portion 36 on the magnetic circuit, the inclined axis of easy magnetization may be formed at a plurality of locations on the magnetic circuit of the core. Further, for example, there may be constructed a constitution in which the magnetic pole portions 33*a* and 33*b* of the core of the excitation electromagnet 30 correspond to an entire circumference portion on the magnetic circuit of the core 11*b* for the transformer and the inclined axis of easy magnetization may be formed at the entire circumference portion.

According to the fourth embodiment, similar to a third embodiment, even when the direct current magnetic deviation is caused, there can be formed the core and the transformer capable of restraining the direct current magnetic deviation by reducing a change in a magnetic flux amount in the core by a core constitution which is not provided with a gap. The exciting operation in annealing is also simple and can be carried out such that an increase in the cost of the core and the transformer is not brought about. Further, according to the technology of the fourth embodiment, the angle of inclination θ of the axis of easy magnetization can be controlled by the direct current magnetic field 32 and the direct current magnetic field 35.

Although normally, there is not present an axis of easy magnetization in an amorphous metal, the axis of easy magnetization is formed by the processing of the third embodiment and the fourth embodiment.

Further, although according to the third embodiment and the fourth embodiment, the electromagnet or the coil is used for excitation, the present invention is not limited thereto but a permanent magnet may be used.

Figure 9:
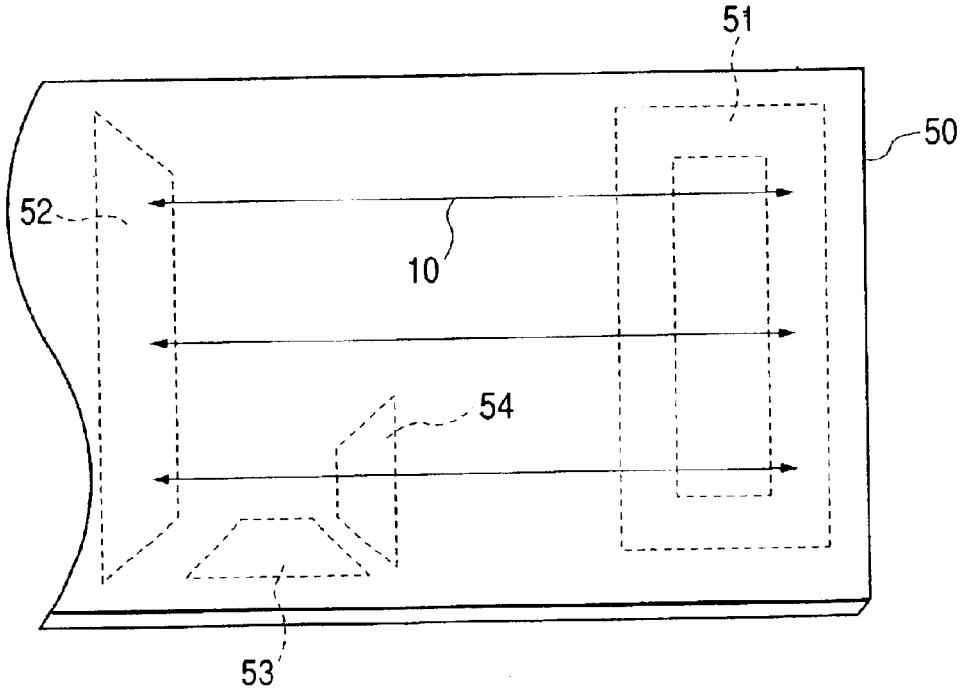
FIG. 9 is an explanatory view of a fifth embodiment and a drawing showing material taking of core parts.
Figure 10A:
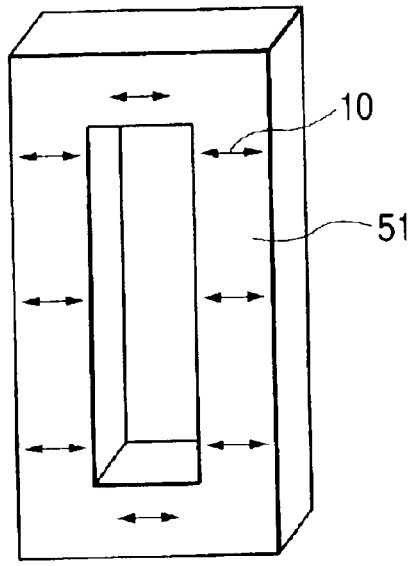
FIGS. 10A and 10B are drawings showing examples of constituting cores for transformers according to the fifth embodiment of the present invention.
Figure 10B:
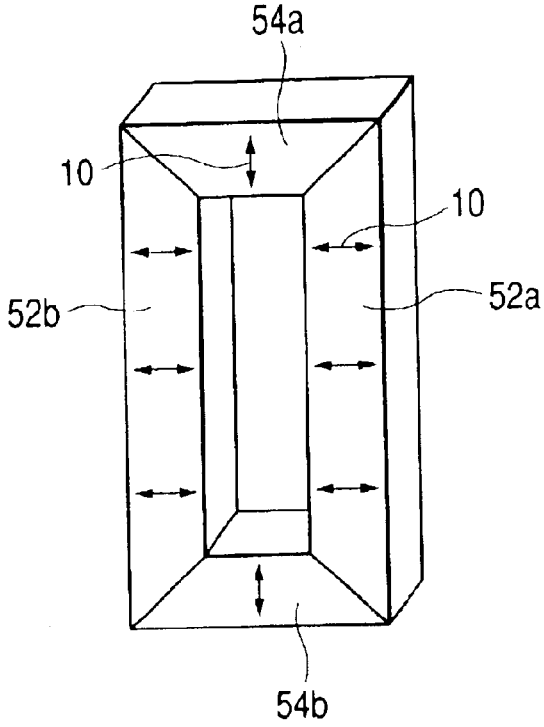

FIG. 9 and FIGS. 10A and 10B show a fifth embodiment of the present invention and are views for explaining other technology of fabricating a core in steps of fabricating a transformer according to the present invention.

The fifth embodiment is an example in the case in which a core part is subjected to material taking (signifying that a part is taken from a material by punching) from a magnetic material having an axis of easy magnetization in a certain direction such that the axis of easy magnetization is directed in a direction intersecting with a longitudinal direction (equal to direction along magnetic circuit) of a core for a transformer by a technology of punching and the core for the transformer is constituted by using thereof.

FIG. 9 is an explanatory view of a magnetic material and material taking of a core part and FIGS. 10A and 10B are views of cores for a transformer constituted by using the core part subjected to material taking.

In FIG. 9, numeral 50 designates a magnetic material such as grain-oriented electromagnetic steel sheet and numeral 10 designates the arrow mark indicating a direction of an axis of easy magnetization of the magnetic material 50 and numerals 51 through 54 designate core parts subjected to material taking by punching.

In FIGS. 10A and 10B, a core for a transformer of FIG. 10A is constituted by laminating a plurality of pieces of the core parts 51 in FIG. 9 and a core for a transformer of FIG. 10B is constituted by respectively laminating pluralities of pieces of the core parts 52 and 54 in FIG. 9. In FIG. 10A, at a long side portion of a magnetic circuit in a rectangular shape, a direction of an axis of easy magnetization is in a direction substantially orthogonal to a longitudinal direction (equal to direction along magnetic circuit) of the core and at a short side portion thereof, the direction of the axis of easy magnetization and a longitudinal direction (equal to direction along magnetic circuit) of the core are in directions substantially the same as each other. In contrast thereto, according to the core for the transformer of FIG. 10B, at both of long side portions and short side portions of a magnetic circuit in a rectangular shape, a direction of an axis of easy magnetization is in a direction substantially orthogonal to a longitudinal direction (equal to direction along magnetic circuit) of the core.

Further, although according to the fifth embodiment, material taking is carried out such that the axis of easy magnetization of the core part becomes substantially orthogonal to or substantially in parallel with the direction of the axis of easy magnetization of the magnetic material 50, otherwise, material taking may be carried out such that the axis of easy magnetization of the core part makes an angle θ other than the above description relative to the axis of easy magnetization of the magnetic material 50. Further, at both of long side portions and short side portions, the direction of the axis of easy magnetization may differ from those in the case of the embodiment.

According to the fifth embodiment, there can be constituted the core and the transformer capable of restraining the direct current magnetic deviation by simple working.

According to the technology of the embodiment, a reduction in loss as well as vibration or noise can be achieved in a state of restraining an increase in dimensions or weight of the transformer. An increase in the cost can also be restrained.

According to the invention, the direct current magnetic deviation can be restrained without providing a gap in the core. Vibration or noise can be restrained in the state of restraining the increase in dimensions or weight of the transformer.

What is claimed is:

1. A method of fabricating a core for a transformer, comprising the steps of:

laminating core members each in a shape of a thin strip and forming thereof in a ring-like shape; and applying a direct current magnetic field in a direction intersecting with a direction along a magnetic current of the transformer to the formed core members in annealing to thereby form an axis of easy magnetization of the core in the direction of the magnetic field.

2. The method of fabricating a core for a transformer according to claim 1, wherein the direct current magnetic field is applied in a direction substantially orthogonal to the direction along the magnetic circuit of the transformer.

3. A method or fabricating a core for a transformer, comprising the steps of:

laminating core members each in a shape of a thin strip and forming thereof in a ring-like shape; and applying a direct current magnetic field in a first direction along a magnetic circuit of a transformer and a direct current magnetic field in a accord direction intersecting with the first direction to the formed core members in annealing thereof to thereby form an axis of easy magnetization of the core in a direction of a magnetic field synthesized with the two direct current magnetic fields.

4. A method of fabricating a core for a transformer, comprising the steps of:

subjecting core parts to material taking from a magnetic material having an axis of easy magnetization substantially in a constant direction such that the axis of easy magnetization is directed in a direction intersecting with a direction along a magnetic circuit of the transformer; and laminating the core members.

* * * * *